US005897830A

United States Patent [19]

Abkowitz et al.

[11] Patent Number: 5,897,830

[45] Date of Patent: Apr. 27, 1999

[54] P/M TITANIUM COMPOSITE CASTING

[75] Inventors: Stanley Abkowitz, Lexington; Susan M. Abkowitz, Winchester; Paul F. Weihrauch, Newton; Harold L. Heussi, Essex; Walter Zimmer, Princeton, all of Mass.

[73] Assignee: Dynamet Technology, Burlington, Mass.

[21] Appl. No.: 08/761,391

[22] Filed: Dec. 6, 1996

[51] Int. Cl.[6] ..... B22F 3/12; B22F 3/14; B22F 5/00; C22C 14/00

[52] U.S. Cl. ..... 420/417; 419/12; 419/13; 419/14; 419/26; 419/38; 419/49; 75/230; 75/245; 164/47; 164/469; 164/474

[58] Field of Search ..... 75/230, 245; 164/47, 164/469, 474; 420/417; 419/12, 13, 14, 26, 38, 49

[56] References Cited

U.S. PATENT DOCUMENTS

| | | | |
|---|---|---|---|
| 4,582,679 | 4/1986 | Wilson et al. | 419/13 |
| 4,601,874 | 7/1986 | Marty et al. | 419/23 |
| 4,731,115 | 3/1988 | Abkowitz et al. | 75/236 |
| 4,906,430 | 3/1990 | Abkowitz et al. | 419/6 |
| 4,909,840 | 3/1990 | Schlump | 75/232 |
| 4,968,348 | 11/1990 | Abkowitz et al. | 75/244 |
| 5,102,451 | 4/1992 | Abkowitz et al. | 75/245 |
| 5,409,518 | 4/1995 | Saito et al. | 75/44 |
| 5,545,248 | 8/1996 | Tokumoto et al. | 75/238 |

*Primary Examiner*—Daniel J. Jenkins

*Attorney, Agent, or Firm*—Finnegan, Henderson, Farabow, Garrett & Dunner, L. L.P.

[57] ABSTRACT

A consumable billet for melting and casting a metal matrix composite component is made of a consolidated powder metal matrix composite having a titanium or titanium alloy matrix reinforced with particles. The preferred billet is a blended and sintered powder metal composite billet incorporating titanium carbide or titanium boride into a Ti—6Al—4V alloy.

44 Claims, 1 Drawing Sheet

500x

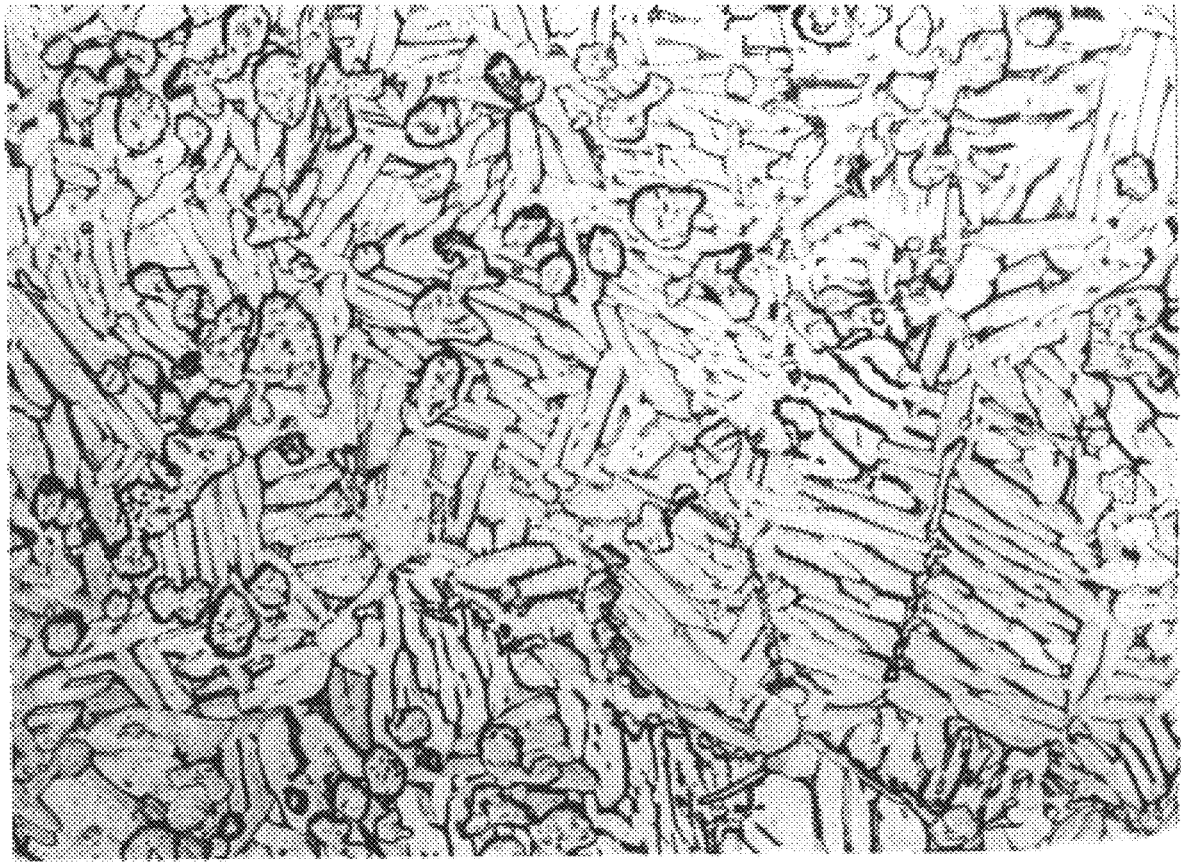
500x

P/M TITANIUM COMPOSITE CASTING

BACKGROUND OF THE INVENTION

1. Field of the Invention

This invention relates to titanium and titanium alloy metal matrix composite billets produced by powder metallurgy for use as melt starting stock to produce metal matrix composite articles by casting.

2. Description of the Related Art

Titanium has many properties that make it an attractive material for high performance applications. For example, it has one of the highest strength-to-weight ratios of the structural metals, and will form a thin, tough protective oxide film making it extremely oxidation resistant.

Titanium and titanium alloy metal matrix composites have been developed for applications requiring enhanced physical and mechanical properties. By incorporating ceramic or intermetallic particles in a titanium alloy matrix, improvements in strength, modulus, hardness and wear resistance have been achieved. These particulate reinforced metal matrix composites are typically manufactured using powder metallurgical (P/M) methods. Examples of P/M processes are described in U.S. Pat. Nos. 4,731,115, 4,906,430, and 4,968,348, each of which is expressly incorporated herein by reference. To produce fully dense structural shapes, one preferred P/M process consists of blending pure titanium powder with appropriate ceramic or intermetallic materials in particulate form, together with alloying additions in either elemental or pre-alloyed powder form, then consolidating the blended powders in a controlled sequence: first, cold isostatic pressing, followed by vacuum sintering at elevated temperature and finally hot isostatic pressing. This CHIP process sequence results in a particulate reinforced metal matrix alloy in the form of a high density or fully dense solid, manufactured to a near-net shape.

Using this process, it is typically necessary to machine the P/M preform to achieve the final component shape and dimensions. Since machining requires a loss of starting material, and incurs significant costs associated with capital equipment, expensive tooling, labor and extended schedule, it is desirable to manufacture some titanium metal matrix composite components directly to the finished dimensions with little or no machining. Articles of titanium and titanium alloys may be produced most economically and repeatably to near net shape by casting.

Castings of titanium and its alloys are typically made by vacuum arc remelting (VAR) process, wherein a consumable electrode billet of the desired alloy composition is progressively melted into the liquid state by an electric current flowing across a voltage potential in the form of a plasma arc. The alloy melts from the electrode tip and collects in a molten pool contained within a crucible. To chemically isolate the highly reactive molten metal from the crucible walls and thus avoid a source of contamination, the crucible walls are actively cooled so that the first molten metal in the crucible forms a solidified layer or "skull." This skull ensures that the molten titanium does not come into direct contact with the crucible, but rather only contacts other titanium metal, thereby minimizing contamination of the final product. After enough molten metal has been collected in the crucible or the electrode billet has been consumed, the liquid metal is poured into a casting mold, wherein the molten metal solidifies and takes on the desired final component shape and dimensions.

Other vacuum melting methods, such as vacuum induction melting (VIM), may be similarly employed to render titanium and titanium alloys molten prior to casting.

The powder metal composite billets of this invention may also serve as starting stock for these melt processes when casting titanium metal matrix composite articles.

SUMMARY OF THE INVENTION

Accordingly, the present invention is directed to a consumable billet for vacuum melting and casting a metal matrix composite component, made of a powder metal matrix composite consisting essentially of a titanium or titanium alloy matrix reinforced with particles.

Another aspect of the invention is drawn to a method of casting a particulate reinforced metal matrix composite article including the steps of providing a consolidated powder billet having a titanium metal matrix and particles dispersed therein, and melting the billet to cast the article.

Yet another aspect of the invention includes a cast titanium alloy metal matrix composite article strengthened by particles dispersed therein, the composite article formed by melting a titanium metal matrix composite formed by consolidating powdered materials It is to be understood that both the foregoing general description and the following detailed description are exemplary and explanatory, and are not restrictive of the invention as claimed.

BRIEF DESCRIPTION OF THE DRAWING

FIG. 1 is micrograph of a TiC reinforced titanium alloy casting produced from an electrode formed by powder metallurgy techniques.

DETAILED DESCRIPTION OF THE PREFERRED EMBODIMENT

The inventors have discovered that a sintered P/M titanium metal matrix composite electrode has significant advantages as the starting consumable billet stock, such as an electrode for vacuum arc melting and casting of near-net shape components. The composite electrode billet may be formed by, for example, cold isostatic pressing and sintering titanium alloy powders with additions of alloying elements and ceramic or intermetallic compounds in powder form. Another example of the billet manufacture is canning, evacuating, and hot isostatic pressing a powder blend of pre-alloyed powders and reinforcing particles.

The fine (e.g., 5 to about 100 microns) particulate reinforcement (e.g., a ceramic or intermetallic compound), once it enters the melt in the form of an incompletely melted solid particulate or a totally liquid entity, will act as a melt inoculant, serving as the nucleation site for the incipient solidification of the titanium alloy matrix, thus refining the resultant cast grain size, and reducing the tendency to develop matrix alloy segregation. In addition, since the composite alloy electrode material was created from uniformly blended fine powders by solid state diffusion bonding during vacuum sintering, the resultant cast material will be more chemically homogeneous and exhibit fewer gas-induced voids and porosity, than material produced by multiple VAR cycles from bulk (large in size and chemically inhomogeneous) alloying components. These microstructural features; gas porosity, large grain size and inhomogeneous distribution of alloying elements, are the most important factors responsible for the degraded properties of castings compared to their wrought or P/M equivalents.

From the point of view of manufacturing castings containing ceramic particles, it is typically difficult to distribute the particulate uniformly because of usually large differences in density between the solid ceramic particle and the liquid matrix alloy, which causes the particles either to settle or to float. The selection of TiC, TiB, and/or $TiB_2$ as the reinforcing particles in titanium and titanium alloy castings minimizes the tendency of the particles to segregate in the casting because these compounds have nearly the same density as the most common titanium alloys. The reinforcing particles can be of a single compound, or mixed compounds of, for example, TiC and TiB particles. The carbide or boride compounds can either be introduced as discreet particles which do not dissolve, or dissolve very slightly in the molten titanium matrix. In another embodiment, carbides or borides can be produced in the final composite by introducing carbon- or boron-containing precursors that dissolve in the molten matrix material and precipitate out as, for example TiC, TiB or $TiB_2$, during solidification.

Furthermore, since the composite starting material is based on P/M fabrication methods, the process facilitates the introduction of innovative titanium matrix alloys. For example, it provides a means of incorporating matrix alloying additions, such as iron, copper, or nickel, that reduce the matrix melting point and range of temperatures over which matrix solidification occurs, and thereby further improve the castability of the metal matrix composite. Metal matrix powders are typically in the range of from 50 to about 250 microns. The metal matrix can be a single titanium alloy or a mixture of any number of titanium alloys. Examples of alloys that may be used include: alpha structure titanium materials such as commercially pure titanium, or near alpha Ti—5Al—2.5Sn, and Ti—8Al—1Mo—1V (unless otherwise indicated, as used herein, "alpha structure" includes both the alpha structure and the near alpha structure); alpha-beta alloys, such as Ti—6Al—4V, Ti—6Al—6V—2Sn or Ti—6Al—2Sn—4Zr—2Mo; or beta alloys (which, as used herein, include beta alloys, beta rich alloys and metastable beta alloys) such as Ti—13Zr—13Nb, Ti—1Al—8V—5Fe, Ti—15Mo—3Al—2.7Nb—0.25Sn and Ti—13V—11Cr—3Al.

In casting experiments, melting by either by vacuum induction or by vacuum arc processes, the vacuum sintered, P/M titanium alloy metal matrix composite starting stock produced pore-free and inclusion-free microstructures and mechanical strength properties as least as high as their CHIP-processed metal matrix composite equivalents. This is demonstrated by the as-cast microstructure shown in FIG. 1. The composite material shown in FIG. 1 had the following composition: 10%TiC in a Ti—6Al—4V matrix. The sample was tested at room temperature to determine its tensile properties. The sample had a tensile strength of 160.1 ksi, a yield stress (0.2% offset) of 158.5 ksi, an elongation (over a gauge length of four times the diameter) percent of 0.2%, and a reduction in area of 1.8%.

A second sample having the same composition was also tested and had a tensile strength of 156 ksi, a yield stress (0.2% offset) of 155.2 ksi, an elongation (four times the diameter) percent of 0.2%, and a reduction in area of 2.4%. A third sample having the same composition had a Rockwell C hardness of 43.

It will be apparent to those skilled in the art that various modifications and variations can be made in the disclosed process and product without departing from the scope or spirit of the invention. For example, Other embodiments of the invention will be apparent to those skilled in the art from consideration of the specification and practice of the invention disclosed herein. It is intended that the specification and examples be considered as exemplary only.

What is claimed is:

1. A consumable billet for melting and casting a metal matrix composite article, said billet comprised of a powder metal matrix composite consisting essentially of a titanium or titanium alloy matrix reinforced with particles.

2. The consumable billet of claim 1, wherein the titanium metal matrix comprises an alpha titanium or alpha titanium alloy.

3. The consumable billet of claim 1, wherein the titanium metal matrix comprises an alpha-beta alloy.

4. The consumable billet of claim 1, wherein the titanium metal matrix comprises a beta alloy.

5. The consumable billet of claim 1, wherein said particles comprise intermetallic compounds.

6. The consumable billet of claim 1, wherein said particles are one or more additives selected from the group consisting of carbon, boron and precursor carbon- or boron-containing compounds that combine with titanium to form titanium carbides or titanium borides.

7. The consumable billet of claim 1, wherein said particles comprise ceramic materials.

8. The consumable billet of claim 1, wherein said particles comprise TiC particles.

9. The consumable billet of claim 1, wherein said particles comprise TiB particles.

10. The consumable billet of claim 1, wherein said particles comprise $TiB_2$ particles.

11. The consumable billet of claim 1, wherein said particles comprise TiC in combination with one or more of TiB and $TiB_2$ particles.

12. The consumable billet of claim 1, wherein said powder metal matrix composite is produced by cold isostatic pressing and vacuum sintering a powder blend consisting essentially of elemental titanium, reinforcing particles, and one or more of elemental and master alloy powders.

13. The consumable billet of claim 1, wherein said powder metal matrix composite is produced by canning, evacuating, and hot isostatic pressing a powder blend consisting essentially of pre-alloyed powders of titanium alloys and reinforcing particles.

14. The consumable billet of claim 1, wherein said powder metal matrix composite consists essentially of 10 weight % TiC dispersed in a Ti—6Al—4V matrix.

15. A method of casting an article comprised of a particulate reinforced metal matrix composite, said method comprising the steps of:

providing a billet comprised of a consolidated powder and having a titanium metal matrix and particles dispersed therein, and melting said billet to cast said article.

16. The method of claim 15, wherein the titanium metal matrix comprises an alpha titanium or alpha titanium alloy.

17. The method of claim 15, wherein the titanium metal matrix comprises an alpha-beta titanium alloy.

18. The method of claim 15, wherein said article consists essentially of 10 weight % TiC dispersed in a Ti—6Al—4V matrix.

19. The method of claim 15, wherein the titanium metal matrix comprises a beta alloy.

20. The method of claim 15, wherein the particles comprise TiC particles.

21. The method of claim 15, wherein the particles comprise TiB particles.

22. The method of claim 15, wherein the particles comprise $TiB_2$ particles.

23. The method of claim 15, wherein said particles are one or more additives selected from the group consisting of carbon, boron and precursor carbon- or boron-containing compounds, and said additives combine with titanium to form titanium carbides or titanium borides.

24. The method of claim 15, wherein said particles comprise TiC in combination with one or more of TiB and $TiB_2$ particles.

25. The method of claim 15, wherein said melting is performed by a vacuum arc melting process.

26. The method of claim 15, wherein said melting is performed by a vacuum induction melting process.

27. The method of claim 15, further comprising producing said billet by cold isostatic pressing and vacuum sintering a powder blend consisting essentially of elemental titanium, reinforcing particles, and one or more of elemental and master alloy powders.

28. The method of claim 15, further comprising producing said billet by canning, evacuating, and hot isostatic pressing a powder blend consisting essentially of pre-alloyed powders of titanium alloys and reinforcing particles.

29. A cast article comprising a titanium alloy metal matrix composite strengthened by particles dispersed therein, said cast article being formed by melting a titanium metal matrix composite formed by consolidating powdered materials.

30. The cast article of claim 29, wherein the titanium metal matrix comprises an alpha titanium or alpha titanium alloy.

31. The cast article of claim 29, wherein the titanium metal matrix comprises an alpha-beta alloy.

32. The cast article of claim 29, wherein the titanium metal matrix comprises a beta alloy.

33. The cast article of claim 29, wherein said particles comprise intermetallic compounds.

34. The cast article of claim 29, wherein said particles are one or more additives selected from the group consisting of carbon, boron and precursor carbon- or boron-containing compounds that combine with titanium to form titanium carbides or titanium borides.

35. The cast article of claim 29, wherein said particles comprise ceramic materials.

36. The cast article of claim 29, wherein said particles comprise TIC particles.

37. The cast article of claim 29, wherein said particles comprise TiB particles.

38. The cast article of claim 29, wherein said particles comprise $TiB_2$ particles.

39. The cast article of claim 29, wherein said particles comprise TIC in combination with one or more of TiB and $TIB_2$particles.

40. The cast article of claim 29, wherein said consolidated powder metal matrix composite is produced by cold isostatic pressing and vacuum sintering a powder blend consisting essentially of elemental titanium, reinforcing particles, and one or more of elemental and master alloy powders.

41. The cast article of claim 29, wherein said consolidated powder metal matrix composite is produced by canning, evacuating, and hot isostatic pressing a powder blend consisting essentially of pre-alloyed powders of titanium alloys and reinforcing particles.

42. The cast article of claim 29, wherein said cast metal matrix composite consists essentially of 10 weight % TiC dispersed in a Ti—6Al—4V matrix.

43. The cast article of claim 29, wherein said melting is performed by a vacuum arc melting process.

44. The cast article of claim 29, wherein said melting is performed by a vacuum induction melting process.

* * * * *